US007409940B2

(12) United States Patent
Riley

(10) Patent No.: US 7,409,940 B2
(45) Date of Patent: Aug. 12, 2008

(54) APPARATUS AND METHOD FOR MAINTAINING CONTROLLED ORIENTATION OF A ROLLER LIFTER FOLLOWER USED IN CONJUNCTION WITH A VARIABLE PHASED LIFTER

(75) Inventor: Michael Bernard Riley, Fort Collins, CO (US)

(73) Assignee: Motive Engineering Co., Fort Collins, CO (US)

( * ) Notice: Subject to any disclaimer, the term of this patent is extended or adjusted under 35 U.S.C. 154(b) by 227 days.

(21) Appl. No.: 11/290,726

(22) Filed: Nov. 30, 2005

(65) Prior Publication Data

US 2007/0119398 A1 May 31, 2007

(51) Int. Cl.
*F01P 11/20* (2006.01)

(52) U.S. Cl. ..... 123/90.5; 123/90.2; 123/90.44; 74/53; 74/569

(58) Field of Classification Search ..... 123/90.16, 123/90.2, 90.39, 90.44, 90.48, 90.5; 74/53, 74/55, 567, 569
See application file for complete search history.

(56) References Cited

U.S. PATENT DOCUMENTS 4,089,234 A 5/1978 Henson et al.
5,022,356 A 6/1991 Morel, Jr. et al.
5,263,386 A 11/1993 Campbell et al.
5,546,899 A 8/1996 Sperling et al.
5,934,232 A 8/1999 Greene et al.
5,947,069 A 9/1999 Koerner
6,155,216 A * 12/2000 Riley ..... 123/90.15
6,209,498 B1 4/2001 Brothers ..... 123/90.5
6,257,189 B1 7/2001 Moertz et al. ..... 123/90.5
6,357,407 B2 3/2002 Brothers ..... 123/90.5
6,736,097 B2 * 5/2004 Riley ..... 123/90.2
6,932,041 B1 * 8/2005 Riley ..... 123/90.44
2004/0065282 A1 4/2004 Riley ..... 123/90.2

OTHER PUBLICATIONS

Lee W. Young, Notification of Transmittal of the International Search Report and the Written Opinion of the International Searching Authority, or the Declaration, Oct. 30, 2007.

* cited by examiner

*Primary Examiner*—Ching Chang
(74) *Attorney, Agent, or Firm*—Merchant & Gould PC; Stanley J. Gradisar

(57) ABSTRACT

In a variable phased valve lifter of an internal combustion engine, two or more roller lifter are allowed to move along constraining faces of a constraining mechanism in a first direction, and the constraining mechanism is allowed to move freely in a second direction. As the roller lifters move through their parallel arcuate paths, the engaging surface(s) of the roller lifters will engage with the constraining face(s) of the constraining mechanism, and each roller lifter will prevent the other from rotating about its longitudinal axis. The roller lifter is thus prevented from rotating about its longitudinal axis as it moves in arcuate fashion in cooperation with the constraining mechanism.

30 Claims, 8 Drawing Sheets

APPARATUS AND METHOD FOR MAINTAINING CONTROLLED ORIENTATION OF A ROLLER LIFTER FOLLOWER USED IN CONJUNCTION WITH A VARIABLE PHASED LIFTER

FIELD OF THE INVENTION

This invention relates to an internal combustion engine using poppet type valves to direct gases into and out of one or more cylinders or cam operated fuel injection units to inject fuel into one or more cylinders. More particularly, the orientation of a roller lifter follower in a pushrod operated engine is to be kept constant during rotation of a rotatable element to alter the phasing of the valves or injectors in the engine.

BACKGROUND OF THE INVENTION

A description of a phasing system for roller lifter followers on a camshaft is given by Riley in U.S. Pat. No. 6,155,216, which is hereby incorporated by reference for all that is taught and disclosed therein. A description of means to maintain orientation of a roller lifter used in conjunction with a variable phase lifter is given by Riley in U.S. Pat. No. 6,932,041, which is hereby incorporated by reference for all that is taught and disclosed therein.

As the rotatable element, such as an eccentric sleeve, is rotated to phase the roller lifter follower (hereinafter simply "roller lifter"), the roller lifter orientation must be controlled to allow the roller to follow the cam lobe on the camshaft. In fixed timing systems a simple pin or plate is usually sufficient to prevent the roller lifter from rotating around its longitudinal axis during operation. The arcuate path of the phased roller lifter requires an extra degree of freedom of movement. Therefore additional measures must be taken in order to maintain controlled orientation of the roller lifter.

SUMMARY OF THE INVENTION

The present invention describes a simple system for providing controlled orientation of two or more roller lifters in a pushrod engine using a phasing device to change the point of contact of the roller lifters on the cam. It also applies to roller lifters that may have curved surfaces for contacting the cam, but may not have rollers.

A description of the need for controlled orientation of roller lifters is given in U.S. Pat. No. 6,932,041. In the present invention roller lifters with the same motion caused by rotation of their respective eccentric sleeves are allowed to move through their arcuate paths, with the orientation mechanism also following the same path in one embodiment. The orientation mechanism may be located in a direction parallel to the axis of the lifter, but it is free to move in the plane perpendicular to that direction. In one embodiment the orientation mechanism will fit snugly over each lifter, as it is the action of two or more moving lifters acting on the orientation mechanism that provides the means of orientation for the other lifter(s). In another embodiment the orientation mechanism need not fit snugly, but is free to slide in a direction parallel to the orienting surfaces on the lifters.

DETAILED DESCRIPTION OF THE INVENTION

Figure 1:
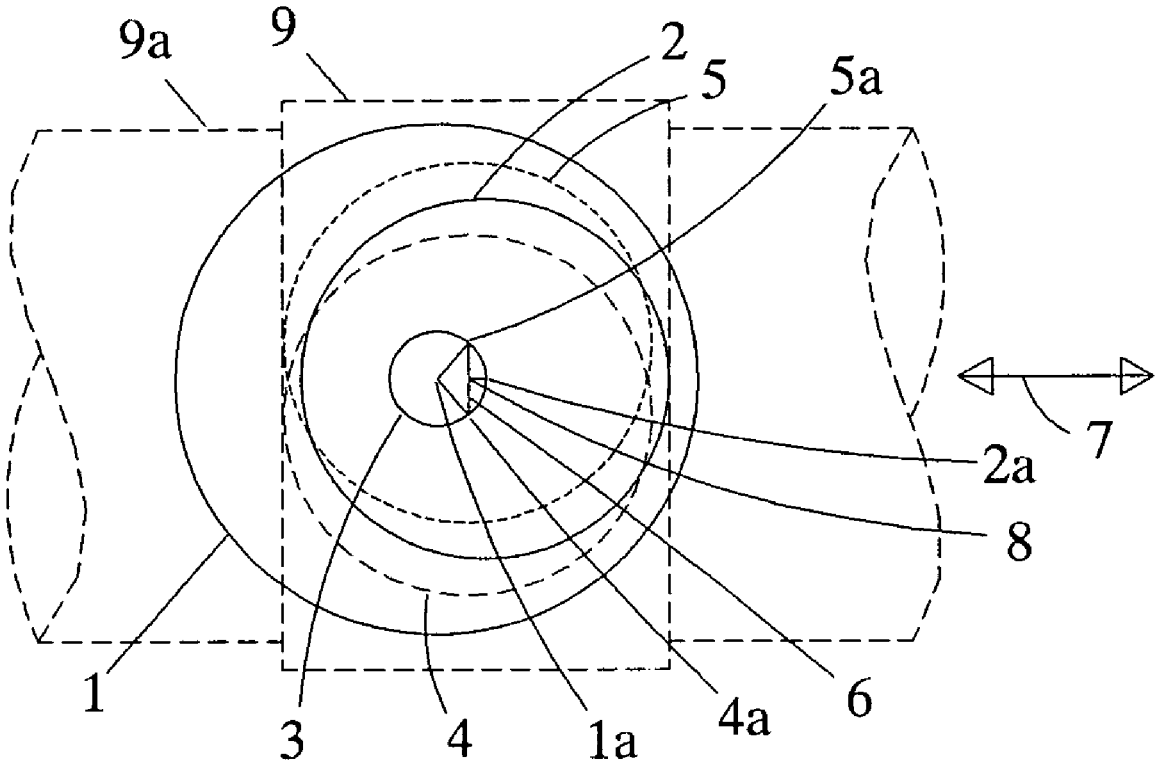
Prior Art FIG. 1
FIG. 1 shows the prior art of how the geometry of rotation of an eccentric sleeve achieves transverse travel of a roller lifter on a cam lobe of a camshaft.
Figure 2:
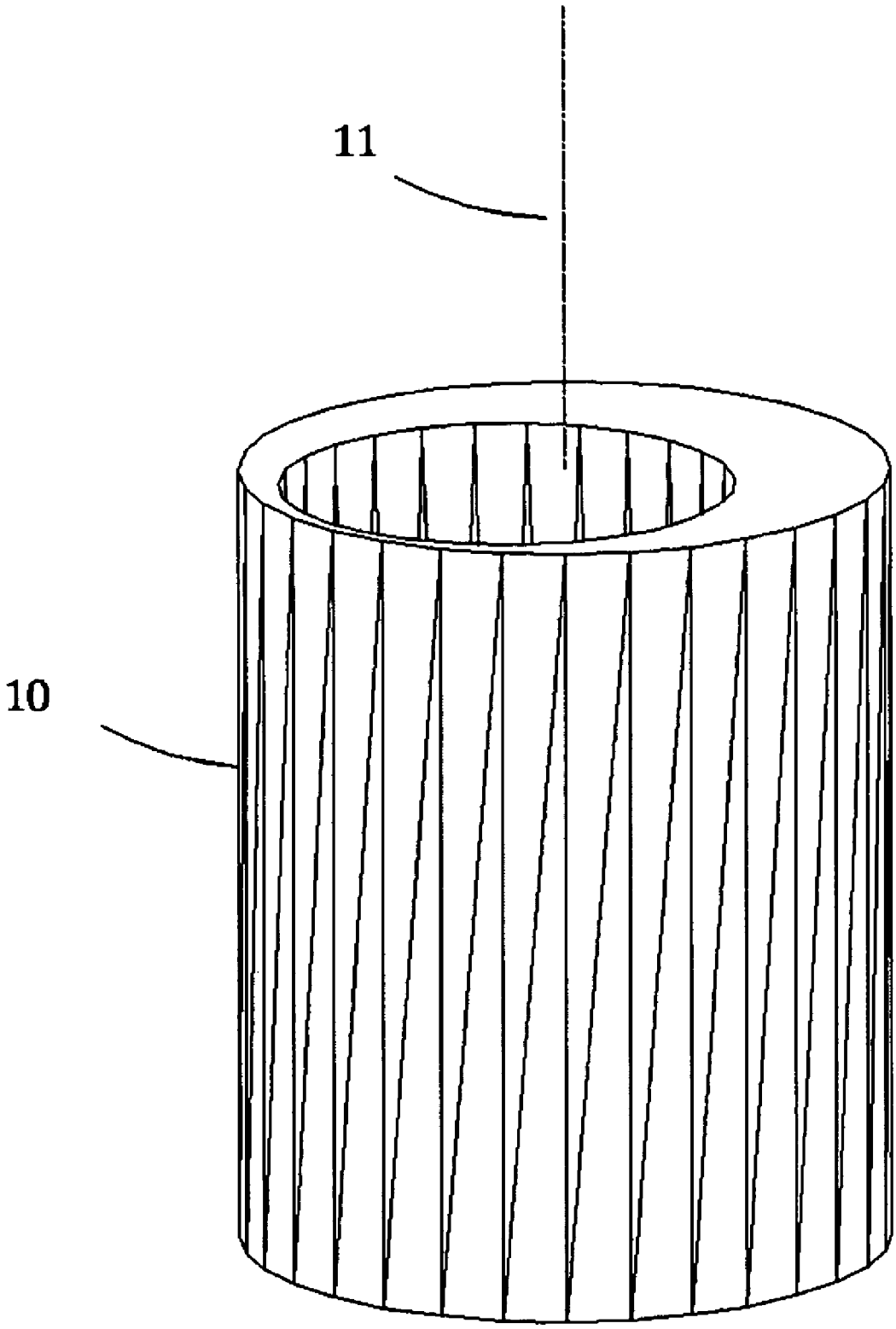
Prior Art FIG. 2
FIG. 2 shows an isometric view of an eccentric sleeve of the prior art.

Referring now to the Figures, in which like reference numerals refer to like components thereof, FIG. 1 shows the prior art of how the geometry of rotation of an eccentric sleeve achieves transverse travel of a roller lifter on a cam lobe of a camshaft, and FIG. 2 shows an isometric view of an eccentric sleeve. Referring now to FIG. 1, the geometry of an eccentric sleeve 10 (FIG. 2), in a view from the top of the roller lifter along the longitudinal axis 11 (FIG. 2) of the roller lifter is shown. Circle 1 is the outside edge of the eccentric sleeve 10, with center 1*a*, and circle 2 is the inside edge of the eccentric sleeve, with center 2*a*, offset from the center 1*a* of the eccentric sleeve. Circle 3 represents the path of the center of the offset as the eccentric sleeve is rotated. Circle 4 with center 4*a* shows the position of the offset when the eccentric sleeve is rotated by some angle, here approximately 60° clockwise, around center 1*a*. Similarly, circle 5 with center 5*a* shows the position of the offset when rotated the same amount, approximately 60°, in the opposite direction around center 1*a*. Line 6, between the centers 4*a* and 5*a* of circles 4 and 5 respectively, shows the distance that the center of the roller lifter (not shown) inside the eccentric sleeve 10 moves transverse to the axis of the camshaft 9*a*, shown as arrow 7. Line 8, perpendicular to line 6, is the farthermost distance to circle 3. Circle 2 corresponds to the outer location of a roller lifter that would make contact with cam lobe 9. Line 8 represents the maximum fore-and-aft movement of the roller lifter along the axial direction of camshaft 9*a*, parallel to arrow 7. FIG. 2 shows an isometric view of eccentric sleeve 10 with its longitudinal axis 11 corresponding to center 1*a* in FIG. 1.

Figure 3:
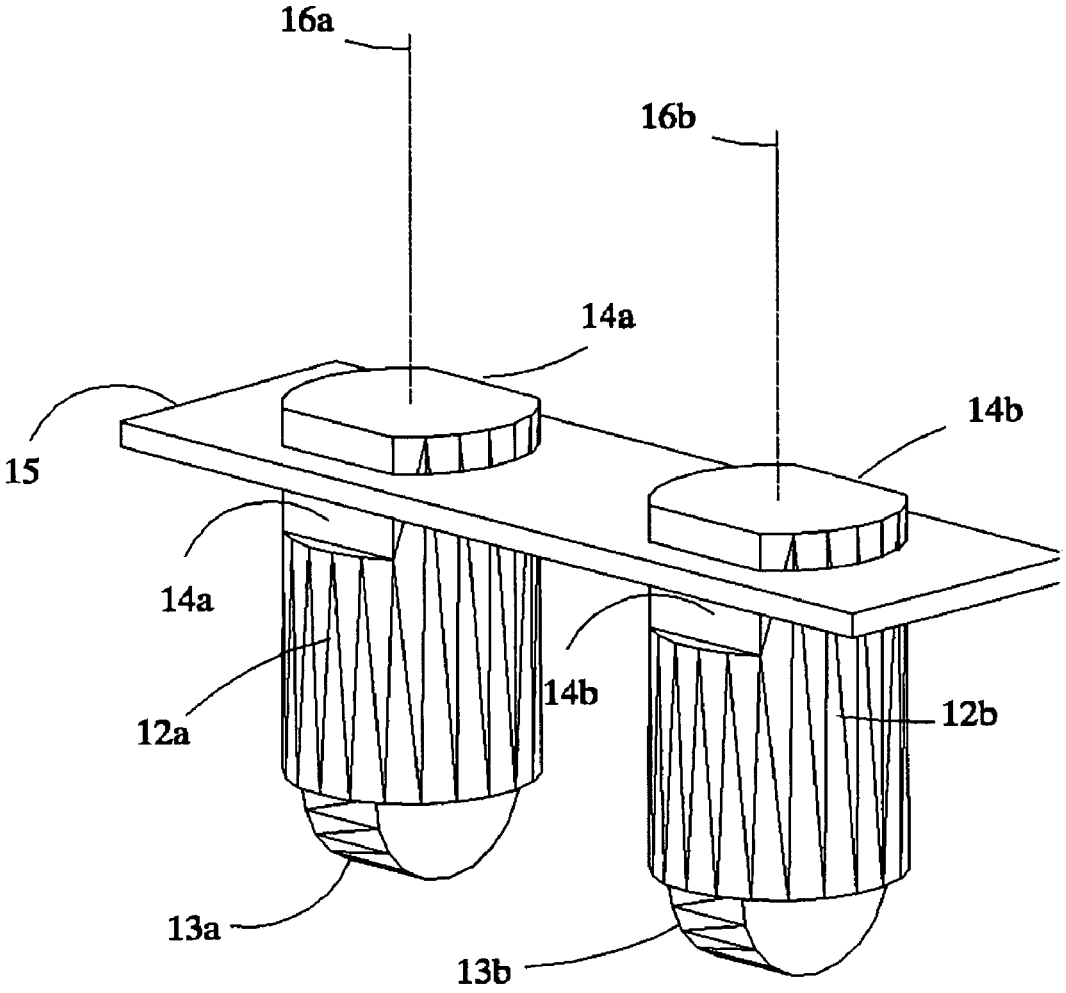
FIG. 3 shows an isometric view of two roller lifters with substantially parallel flat surfaces with one yoke-like constraining mechanism with two openings that are only slightly larger than the lifters that the constraining mechanism captures.

FIG. 3 shows an isometric view of two roller lifters with substantially parallel flat surfaces with one yoke-like constraining mechanism with slots into which the two roller lifters fit of the present invention. Referring now to FIG. 3, an isometric view of two roller lifters 12*a* and 12*b*, with rollers 13*a* and 13*b* and flat surfaces 14*a* and 14*b* which are substantially parallel to each other, engaged by constraining mechanism 15 is shown. Any tendency by roller lifter 12*a* to rotate about its longitudinal axis 16*a* will be countered by the inability of roller lifter 12*b* to rotate about longitudinal axis 16*a* of roller lifter 12*a*, and vice versa for roller lifter 12*a* attempting to rotate about longitudinal axis 16*b* of roller lifter 12*b* due to the mutual constraint provided by constraining mechanism 15. This requires that each eccentric sleeve 10 (see FIG. 2) that surrounds each group of jointly constrained roller lifters (12*a* and 12*b* here) has the same angular displacement of the center of the lifter bore (longitudinal axes 16*a* and 16*b*) from the center of the each sleeve (longitudinal axis 11 in FIG. 2).

Figure 4:
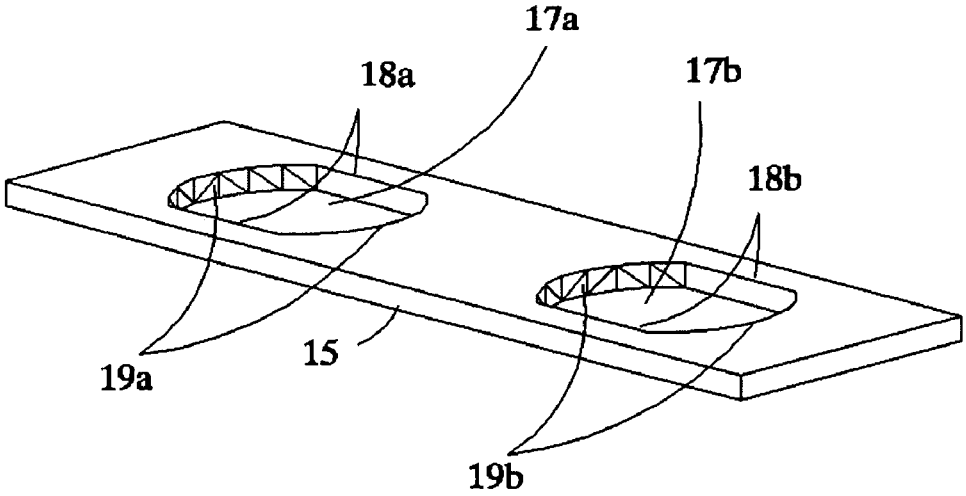
FIG. 4 shows the constraining mechanism from FIG. 3, and highlights the interior surfaces.

FIG. 4 shows an isometric view of constraining mechanism 15 from FIG. 3. Referring now to FIG. 4, the constraining mechanism 15 contains two apertures 17*a* and 17*b* that capture roller lifters 12*a* and 12*b* respectively (see FIG. 3) whose parallel sides 18*a* and 18*b* fit closely over the parallel flat surfaces 14*a* and 14*b* of roller lifters 12*a* and 12*b* (see FIG. 3), and whose curved sides 19*a* and 19*b* fit closely over the curved portions of roller lifters 12*a* and 12*b* (see FIG. 3). Parallel sides 18*a* and 18*b* and curved sides 19*a* and 19*b* are the inside edges of apertures 17*a* and 17*b* of constraining mechanism 15, and are substantially flat and aligned substantially parallel with longitudinal axes 16*a* and 16*b* and flat surfaces 14*a* and 14*b* of roller lifters 12*a* and 12*b*. When roller lifters 12*a* and 12*b* move through their parallel arcuate paths, each point on constraining mechanism 15 moves through the same path, and maintains the orientation of roller lifters 12*a* and 12*b* with respect to their respective longitudinal axes 16*a* and 16*b*.

One skilled in the art will recognize that roller lifters 12*a* and 12*b* could each have just one flat surface 14*a* and 14*b*, and corresponding constraining mechanism 15 would have within apertures 17*a* and 17*b* only one flat surface 18*a* and 18*b*. Also, the flat surfaces 14*a*/14*b* for one roller lifter 12*a*/12*b* and flat surfaces 18*a*/18*b* for apertures 17*a*/17*b* could be on the same side in relation to each other, or on opposite sides in relation to each other.

Figure 5:
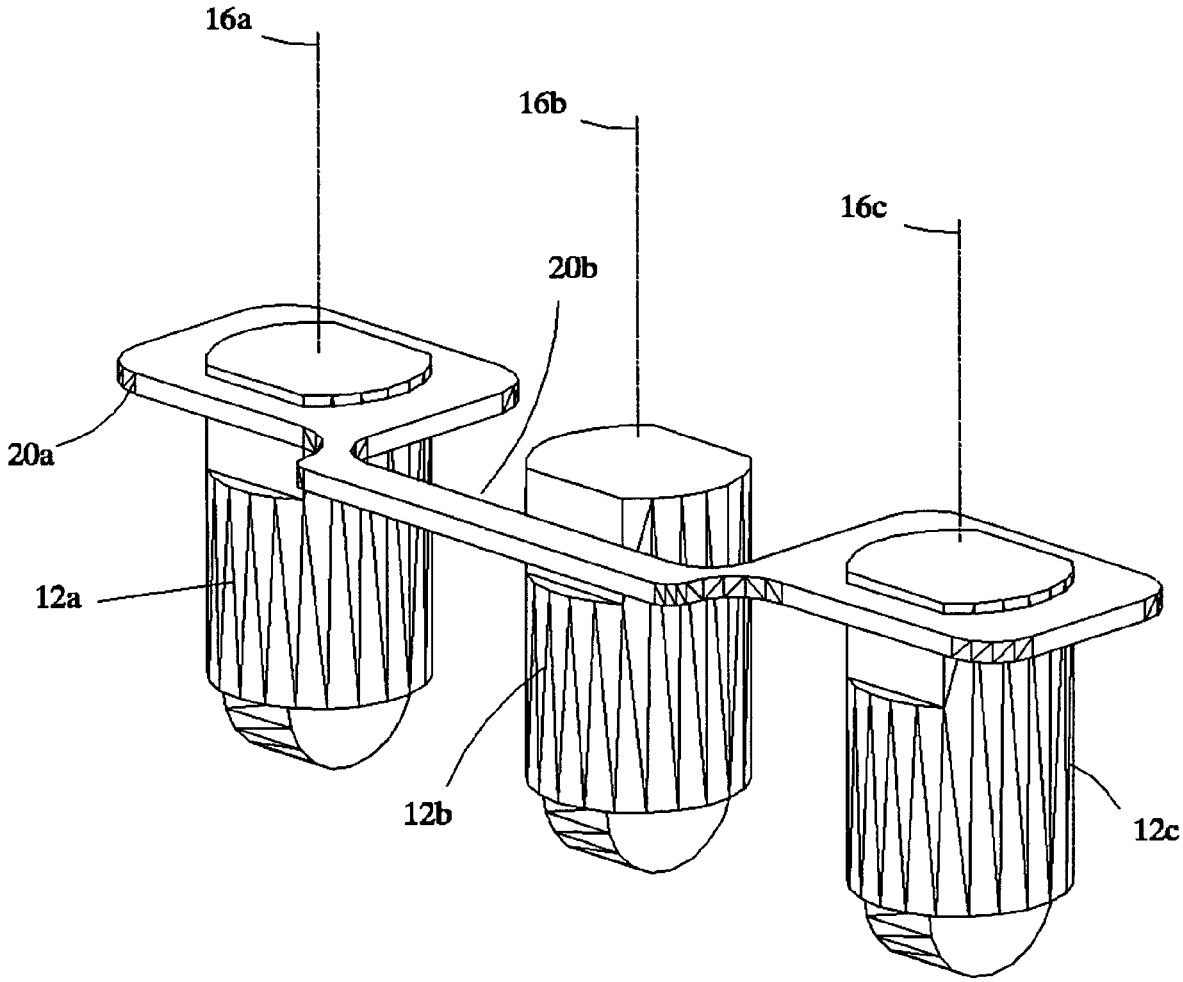
FIG. 5 shows an isometric view of three roller lifters, with the outer two being constrained by a constraining mechanism, and the interior lifter not being so constrained.

FIG. 5 shows an isometric view of a constraining mechanism orienting two roller lifters on either side of another roller lifter that is not being constrained by the same mechanism. Referring now to FIG. 5, the constraining mechanism 20*a* with extension member 20*b* captures roller lifters 12*a* and 12*c*, with roller lifter 12*b* not captured because extension member 20*b* does not touch roller lifter 12*b*. This allows orientation of roller lifters 12*a* and 12*c* with respect to each others' longitudinal axes 16*a* and 16*c*, but allows roller lifter 12*b* to orient independently about its longitudinal axis 16*b*.

Figure 6:
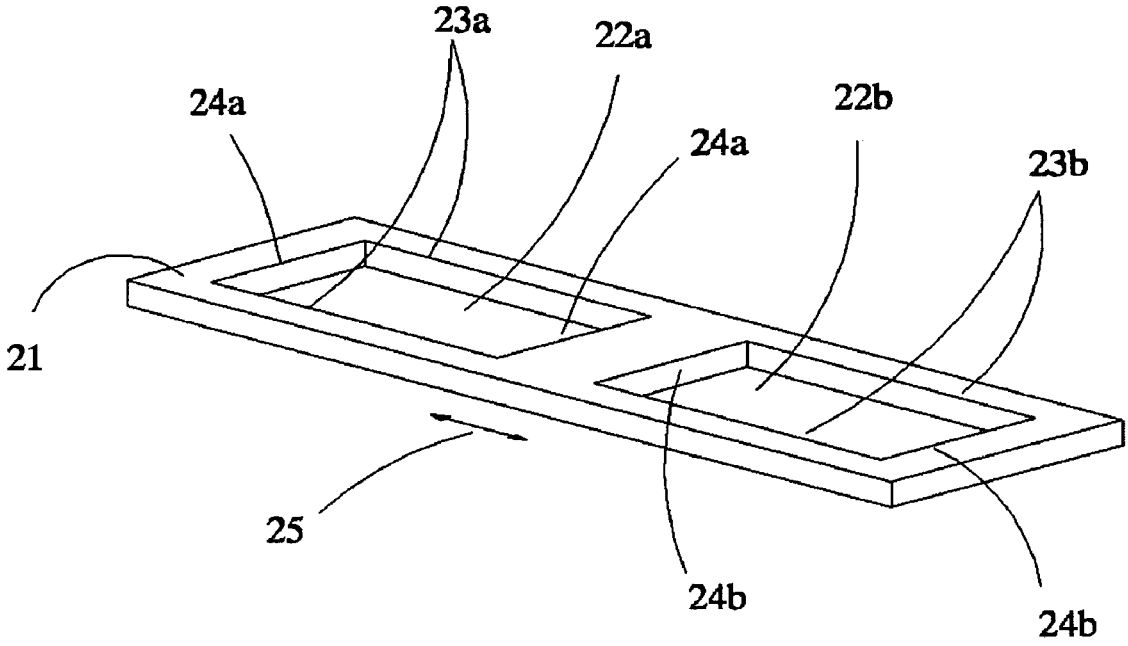
FIG. 6 shows an isometric view of a constraining mechanism that fits snugly over the parallel flat sides of two roller lifters, such as those in FIG. 3, but has a loose fit over the remaining faces of the lifters.

FIG. 6 shows an isometric view of a constraining mechanism with elongated apertures compared to the close-fitting apertures shown in FIGS. 3 and 4. Referring now to FIG. 6, the constraining mechanism 21 contains two apertures 22*a* and 22*b* whose parallel sides 23*a* and 23*b* fit closely over the parallel flat surfaces 14*a* and 14*b* (see FIG. 3) of roller lifters 12*a* and 12*b* (see FIG. 3), and whose other loose fitting sides 24*a* and 24*b* do not fit closely over the curved surfaces of roller lifters 12*a* and 12*b* (see FIG. 3.) This additional clearance to the curved surfaces allows constraining mechanism 21 to slide freely back and forth in a direction parallel to arrow 25. Thus when roller lifters 12*a* and 12*b* move through their parallel arcuate paths, constraining mechanism 21 maintains the orientation of roller lifters 12*a* and 12*b* with respect to their longitudinal axes 16*a* and 16*b* (see FIG. 3) without having to follow exactly the same arcuate path.

Figure 7:
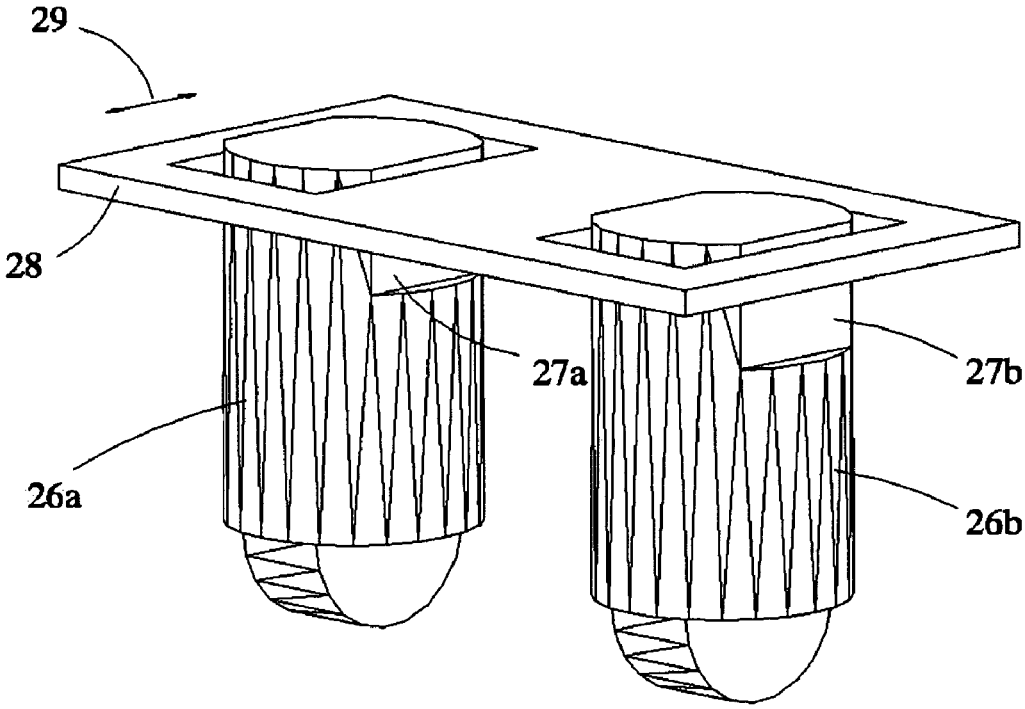
FIG. 7 shows a yoke arrangement as in FIG. 6 capturing two roller lifters, but with the flat sides of the lifter rotated 90° from the orientation of FIGS. 3 and 6.

FIG. 7 shows an isometric view of two roller lifters captured by a constraining mechanism with the location of the flat surfaces on the roller lifter located essentially perpendicular to their position in FIG. 3, where the direction of movement of the constraining mechanism is also substantially perpendicular to that shown in FIG. 6. Referring now to FIG. 7, this embodiment of the invention shows roller lifters 26*a* and 26*b* with flat surfaces 27*a* and 27*b* that are substantially perpendicular to flat surfaces 14*a* and 14*b* on roller lifters 12*a* and 12*b* in FIG. 3. In addition, constraining mechanism 28 is free to slide back and forth in a direction parallel to arrow 29, substantially perpendicular to the movement of constraining mechanism 21, shown by arrow 25 in FIG. 6. Flat surfaces 14*a* and 14*b* on roller lifters 12*a* and 12*b* and surfaces 27*a* and 27*b* on roller lifters 26*a* and 26*b* may be located at any orientation between those shown in FIG. 3 and FIG. 7 as long as the interior mating edges of the constraining mechanism to these flat surfaces are substantially parallel to each other.

Figure 8:
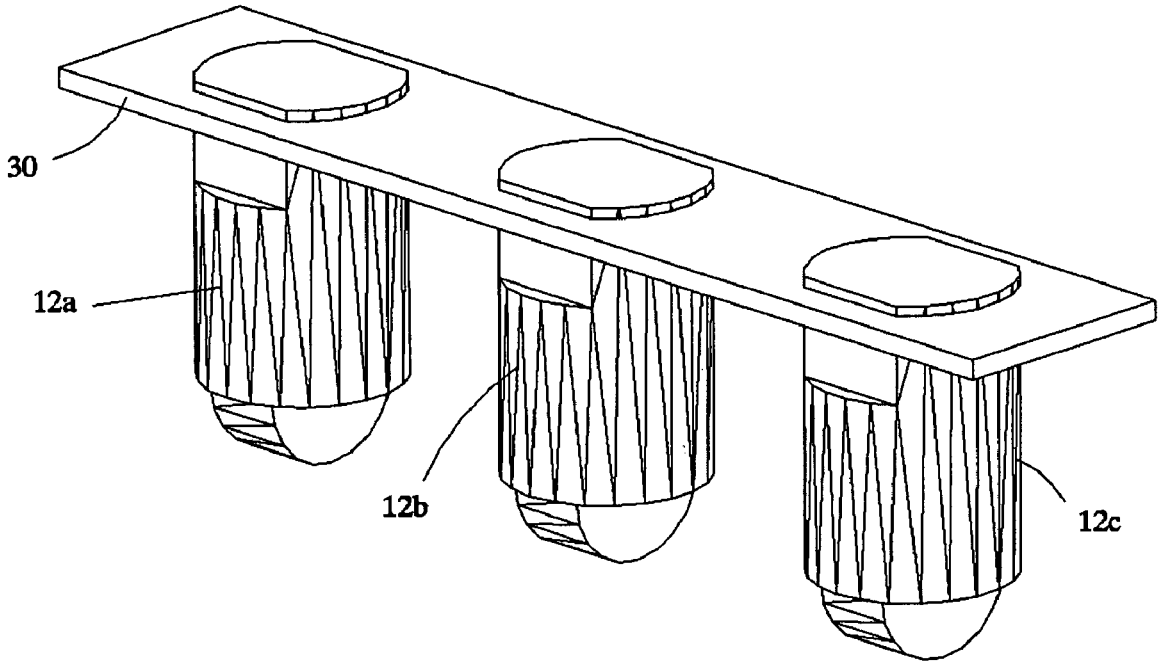
FIG. 8 shows the same arrangement as FIG. 3 but with three lifters constrained by one yoke.

FIG. 8 shows an isometric view of three lifters with a single constraining mechanism of the present invention. Referring now to FIG. 8, an isometric view of multiple lifters with a common, close-fitting constraining mechanism 30 ensuring controlled orientation of all three roller lifters 12*a*, 12*b* and 12*c* is shown. One skilled in the art will recognize that any number of lifters greater than two may be constrained in this manner. Similarly the orientation of the apertures of the constraining mechanism may be varied as shown above.

Figure 9:
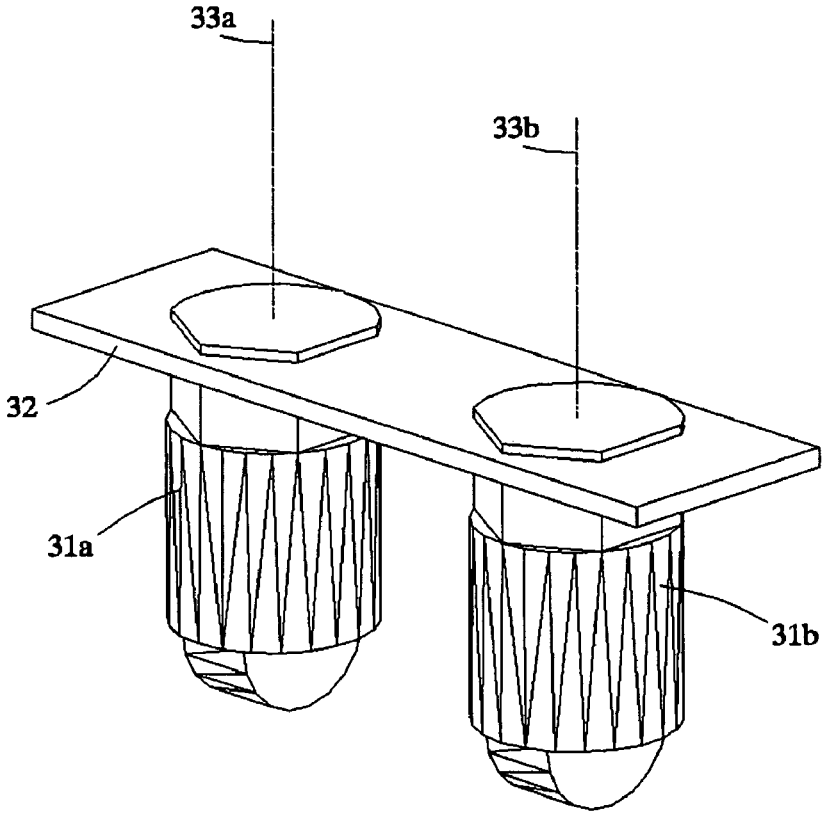
FIG. 9 shows an unusual shape to the lifters and the matching shape on the constraining yoke.

FIG. 9 shows an isometric view of two roller lifters with a constraining mechanism containing arbitrary shaped apertures of the present invention. Referring now to FIG. 9, an isometric view of two roller lifters 31*a* and 31*b* with a constraining mechanism 32 is shown. The shape at the upper end of roller lifters 31*a* and 31*b* is intended to indicate any arbitrary or irregular geometry with sides parallel to roller lifter longitudinal axes 33*a* and 33*b*. Similarly there are correspondingly shaped apertures in constraining mechanism 32 that capture roller lifters 31*a* and 31*b* to maintain their orientation with respect to lifter longitudinal axes 33*a* and 33*b*. One skilled in the art will recognize that additional arbitrary shapes to the upper portions of roller lifters 31*a* and 31*b* and corresponding shaped apertures to constraining mechanism 32 could be substituted and still perform the functionality of constraining the orientation of the roller lifters.

Figure 10:
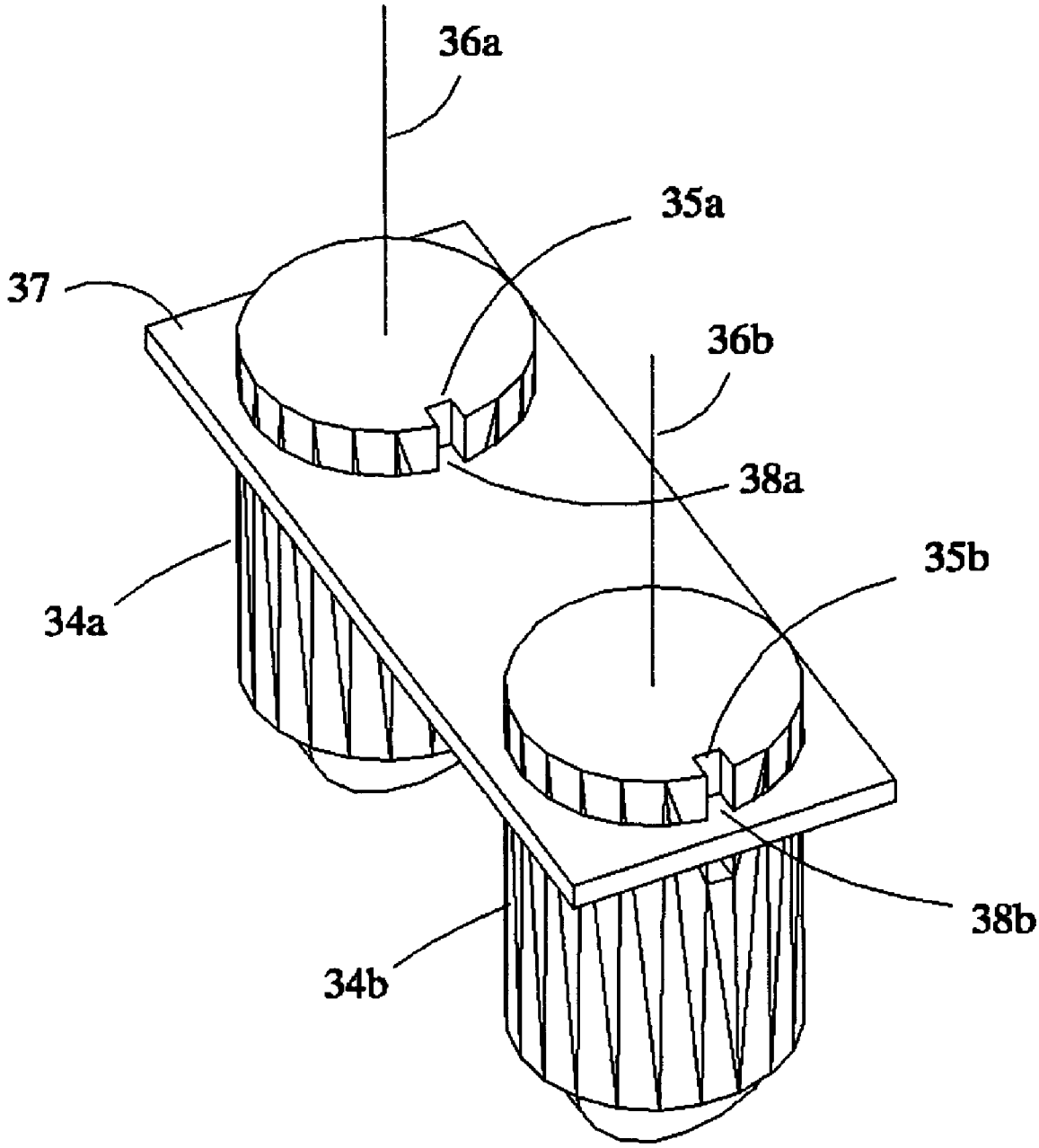
FIG. 10 shows a constraining yoke with pins to engage a mating slot on each of two roller lifters.

FIG. 10 shows an isometric view of two roller lifters with locating slots and a constraining mechanism of the present invention with matching tangs to fit the slots. Referring now to FIG. 10, an isometric view of two roller lifters 34*a* and 34*b* with longitudinal slots 35*a* and 35*b* parallel to longitudinal axes 36*a* and 36*b* of roller lifters 34*a* and 34*b* is shown. Constraining mechanism 37 has two tangs 38*a* and 38*b* that engage with longitudinal slots 35*a* and 35*b* of roller lifters 34*a* and 34*b* and so maintain controlled alignment of roller lifters 34*a* and 34*b* about their longitudinal axes 36*a* and 36*b*.

Figure 11:
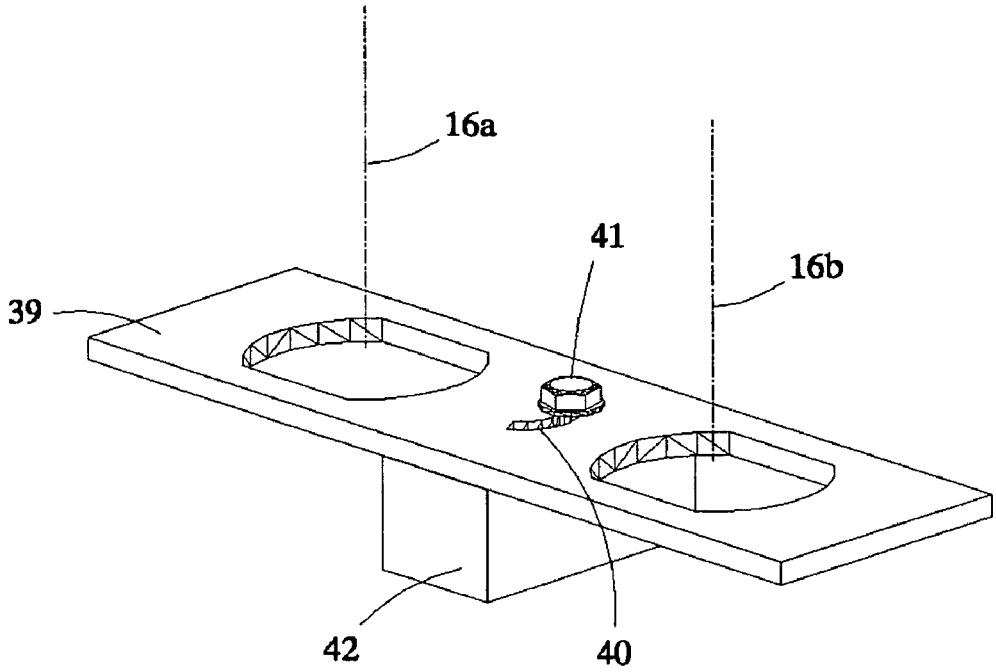
FIG. 11 shows a view of the constraining yoke from FIG. 3 with its own constraining mechanism to maintain its position in the direction parallel to the axis of the lifter and sleeve.

FIG. 11 shows an isometric view of a means of constraining the constraining mechanism of the present invention. Referring now to FIG. 11, an isometric view of constraining mechanism 39 is shown. It should be apparent that constraining mechanism 39 is the same geometry as constraining mechanism 15 from FIG. 3, but with an arcuate fastener slot 40 parallel to the paths that the longitudinal axes 16*a* and 16*b* of roller lifters 12*a* and 12*b* from FIG. 3 would follow when moved by an eccentric sleeve (see FIG. 2). A fastener 41 acts to constrain constraining mechanism 39 from moving in a direction parallel to longitudinal axes 16*a* and 16*b*. Fastener 41 attaches to block 42 which is considered to be part of the structure containing the eccentric sleeves and lifters (not shown). Fastener 41 may contain a spacer or other mechanical separator that prevents fastener 41 from restricting the ability of constraining mechanism 39 from moving in a plane perpendicular to longitudinal axes 16*a* and 16*b*. To anyone skilled in the art, it should be obvious that fastener slot 40 may have a large variety of shapes, provided that fastener 41 is capable of providing the necessary constraint to prevent constraining mechanism 39 from moving out of its plane of movement perpendicular to longitudinal axes 16*a* and 16*b*.

Figure 12:
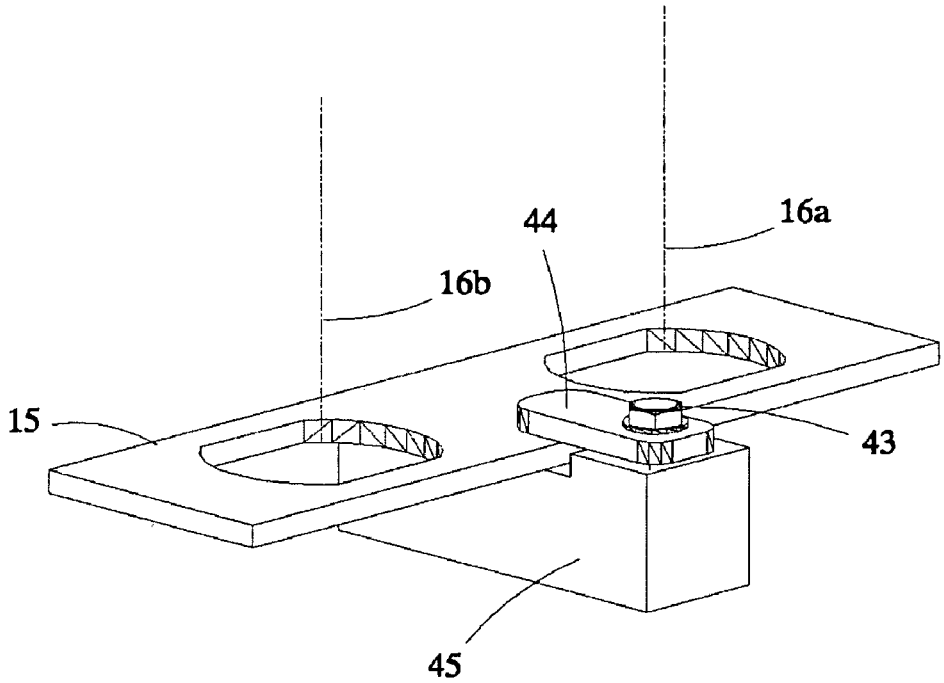
FIG. 12 shows another embodiment of a mechanism to constrain the movement of the constraining yoke in a direction parallel to the axis of the lifter and sleeve.

FIG. 12 shows an isometric view of a means of constraining the constraining mechanism of the present invention. Referring now to FIG. 12, an isometric view of constraining mechanism 15 is shown. Now instead of having fastener 41 penetrating constraining mechanism 15, fastener 43 secures tab 44 to block 45, which is considered to be part of the structure containing the eccentric sleeves and lifters (not shown). Tab 44 and block 45 act to constrain the movement of constraining mechanism 15 in a plane perpendicular to longitudinal axes 16*a* and 16*b*. This results in constraining mechanism 15 allowing roller lifters 12*a* and 12*b* to move freely in the direction of their longitudinal axes 16*a* and 16*b*, and when roller lifters 12*a* and 12*b* are rotated about said axes by simultaneous rotation of like phased eccentric sleeves (not shown) constraining mechanism 15 is free to slide between tab 44 and block 45, maintaining the required orientation of roller lifters 12*a* and 12*b*.

Having described the present invention, it will be understood by those skilled in the art that many changes in construction and widely differing embodiments and applications of the invention will suggest themselves without departing from the scope of the present invention.

What is claimed is:

1. A method for controlling the orientation of at least two roller lifters in an internal combustion engine having at least two rotatable elements that eccentrically move the at least two roller lifters to alter the phasing of the at least two roller lifters engaging with a cam, the method comprising the steps of:

(a) receiving the at least two roller lifters in at least two apertures of a constraining mechanism;

(b) rotating the at least two rotatable elements that eccentrically move the at least two roller lifters;

(c) allowing by said constraining mechanism the at least two roller lifters to move in a direction parallel to each of their respective longitudinal axes; and (d) preventing by said constraining mechanism each of the at least two roller lifters from rotating about each of their said respective longitudinal axes;

wherein each point on said constraining mechanism moves through a same parallel arcuate path as the at least two roller lifters.

2. The method according to claim 1 wherein step (a) further comprises the step of:

engaging at least one flat surface of said at least two apertures of said constraining mechanism with a corresponding at least one flat surface of each of said at least two roller lifters.

3. The method according to claim 1 wherein step (a) further comprises the step of:

engaging at least one curved surface of said at least two apertures of said constraining mechanism with a corresponding at least one curved surface of each of said at least two roller lifters.

4. The method according to claim 1 wherein step (a) further comprises the step of:

fitting closely said at least two apertures of said constraining mechanism to a corresponding exterior circumferential shape of the at least two roller lifters.

5. The method according to claim 1 wherein step (a) further comprises the steps of:

engaging closely at least two flat parallel surfaces of said at least two apertures of said constraining mechanism with a corresponding at least two flat parallel surfaces of each of said at least two roller lifters; and fitting loosely at least two surfaces perpendicular to said at least two flat parallel surfaces of said at least two apertures with a perpendicular other surfaces of the at least two roller lifters.

6. The method according to claim 1 wherein step (a) further comprises the step of:

aligning closely at least one feature on each of the at least two roller lifters with said at least two apertures of said constraining mechanism, wherein said at least one feature is parallel with said respective longitudinal axes.

7. The method according to claim 6 wherein said aligning step further comprises the step of:

aligning a flat surface on each of the at least two roller lifters with a corresponding flat surface on each of said at least two apertures of said constraining mechanism.

8. The method according to claim 6 wherein said aligning step further comprises the step of:

aligning at least two flat parallel surfaces on each of the at least two roller lifters with a corresponding at least two flat parallel surfaces on each of said at least two apertures of said constraining mechanism.

9. The method according to claim 6 wherein said aligning step further comprises the step of:

aligning at least two flat surfaces that are at an angle to each other on each of the at least two roller lifters with a corresponding at least two flat surfaces that are at said angle to each other on each of said at least two apertures of said constraining mechanism.

10. The method according to claim 6 wherein said aligning step further comprises the step of:

aligning a longitudinal slot on each of the at least two roller lifters with a corresponding tang in each of said at least two apertures of said constraining mechanism.

11. The method according to claim 6 wherein said aligning step further comprises the step of:

aligning an arbitrary or irregular circumferential geometry on each of the at least two roller lifters with an identical arbitrary or irregular circumferential geometry of each of said at least two apertures of said constraining mechanism.

12. The method according to claim 1 further comprising the step of:

constraining movement of said constraining mechanism in a direction parallel to said longitudinal axes while allowing said constraining mechanism to move freely in a direction perpendicular to said longitudinal axes.

13. The method according to claim 1 further comprising the step of:

forming an arcuate fastener slot in said constraining mechanism, said arcuate fastener slot being shaped parallel to the paths that said longitudinal axes follow when moved by the at least two rotatable elements;

attaching a block to a structure containing the at least two rotatable elements; and inserting a fastener through said arcuate fastener slot and into said block.

14. The method according to claim 1 further comprising the step of:

attaching a block to a structure containing the at least two rotatable elements; and extending a tab over said constraining mechanism; and inserting a fastener through said tab and into said block.

15. The method according to claim 1 further comprising the step of:

not receiving a third roller lifter located between the at least two roller lifters in said constraining mechanism through an extension member that does not touch said third roller lifter, allowing said third roller lifter to orient independently about its longitudinal axis and not said longitudinal axes of the at least two roller lifters.

16. An apparatus in an internal combustion engine having at least two rotatable elements that eccentrically move at least two roller lifters to alter the phasing of the at least two roller lifters engaging with a cam, the apparatus comprising:

a constraining mechanism having at least two apertures, wherein each of said at least two apertures receives a one of the at least two roller lifters;

wherein as the at least two rotatable elements eccentrically move the at least two roller lifters, said constraining mechanism allows each of the at least two roller lifters to move freely in a direction parallel to each of their respective longitudinal axes, and prevents each of the at least two roller lifters from rotating about each of their said respective longitudinal axes, and further wherein each point on said constraining mechanism moves through a same parallel arcuate path as the at least two roller lifters.

17. The apparatus according to claim 16 wherein said at least two apertures of said constraining mechanism further comprises at least one flat surface, wherein each of said at least one flat surface engages with a corresponding at least one flat surface of each of said at least two roller lifters.

18. The apparatus according to claim 17 wherein said at least two apertures of said constraining mechanism further comprises at least one curved surface, wherein each of said at least one curved surface engages with a corresponding at least one curved surface of each of said at least two roller lifters.

19. The apparatus according to claim 17 wherein said at least two apertures of said constraining mechanism fit closely to a corresponding exterior circumferential shape of the at least two roller lifters each received in said at least two apertures.

20. The apparatus according to claim 16 wherein said at least two apertures of said constraining mechanism further comprises at least two flat parallel surfaces, wherein each of said at least two flat parallel surfaces engages with a corresponding at least two flat parallel surfaces of each of said at least two roller lifters, wherein said at least two flat parallel surfaces of said at least two apertures of said constraining mechanism fit closely respectively with said at least two flat parallel surfaces of said at least two roller lifters, and said at least two surfaces perpendicular to said at least two flat parallel surfaces of said at least two apertures fit loosely over a perpendicular other surfaces of the at least two roller lifters.

21. The apparatus according to claim 16 further comprising:

at least one feature on each of the at least two roller lifters that closely aligns with said at least two apertures of said constraining mechanism, wherein said at least one feature is parallel with said respective longitudinal axes.

22. The apparatus according to claim 21 wherein said at least one feature on each of the at least two roller lifters is a flat surface.

23. The apparatus according to claim 21 wherein said at least one feature on each of the at least two roller lifters is at least two flat surfaces, wherein said at least two flat surfaces are parallel to each other.

24. The apparatus according to claim 21 wherein said at least one feature on each of the at least two roller lifters is at least two flat surfaces, wherein said at least two flat surfaces are at an angle to each other.

25. The apparatus according to claim 21 wherein said at least one feature on each of the at least two roller lifters is a longitudinal slot that mates with a tang in each of said at least two apertures of said constraining mechanism.

26. The apparatus according to claim 21 wherein said at least one feature on each of the at least two roller lifters is an arbitrary or irregular circumferential geometry that mates with an identical arbitrary or irregular circumferential geometry of each of said at least two apertures of said constraining mechanism.

27. The apparatus according to claim 16 further comprising:

a means for constraining movement of said constraining mechanism in a direction parallel to said longitudinal axes while allowing said constraining mechanism to move freely in a direction perpendicular to said longitudinal axes.

28. The apparatus according to claim 16 further comprising:

an arcuate fastener slot in said constraining mechanism, said arcuate fastener slot being shaped parallel to the paths that said longitudinal axes follow when moved by the at least two rotatable elements;

a block that is part of a structure containing the at least two rotatable elements; and a fastener inserted though said arcuate fastener slot and into said block;

wherein said fastener, said arcuate fastener slot, and said block constrain said constraining mechanism from movement in a direction parallel to said longitudinal axes while allowing said constraining mechanism to move freely in a direction perpendicular to said longitudinal axes.

29. The apparatus according to claim 16 further comprising:

a block that is part of a structure containing the at least two rotatable elements;

a tab which extends over said constraining mechanism; and a fastener inserted through said tab and into said block;

wherein said fastener, said tab, and said block constrain said constraining mechanism from movement in a direction parallel to said longitudinal axes while allowing said constraining mechanism to move freely in a direction perpendicular to said longitudinal axes.

30. The apparatus according to claim 16 wherein said constraining mechanism further comprises:

an extension member, wherein a third roller lifter located between the at least two roller lifters is not captured by said constraining mechanism, allowing said third roller lifter to orient independently about its longitudinal axis and not said longitudinal axes of the at least two roller lifters.

* * * * *